US007400841B2

(12) United States Patent
Uchida et al.

(10) Patent No.: US 7,400,841 B2
(45) Date of Patent: Jul. 15, 2008

(54) COLOR IMAGE FORMING DEVICE

(75) Inventors: Shinichi Uchida, Osaka (JP); Koichiro Tsujimoto, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 158 days.

(21) Appl. No.: 11/163,777

(22) Filed: Oct. 31, 2005

(65) Prior Publication Data

US 2006/0093391 A1 May 4, 2006

(30) Foreign Application Priority Data

Oct. 29, 2004 (JP) ..... 2004-316783
Dec. 21, 2004 (JP) ..... 2004-370006

(51) Int. Cl.
*G03G 21/20* (2006.01)

(52) U.S. Cl. ..... 399/92; 399/94

(58) Field of Classification Search ..... 399/91–94, 399/98

See application file for complete search history.

(56) References Cited

U.S. PATENT DOCUMENTS 5,905,010 A 5/1999 Nakamura et al.
6,356,722 B1 * 3/2002 Kida ..... 399/92

FOREIGN PATENT DOCUMENTS

| | | | |
|---|---|---|---|
| JP | S62/182768 | A | 8/1987 |
| JP | H10/198149 | A | 7/1998 |
| JP | 2000/98860 | A | 4/2000 |
| JP | 2001/134045 | A | 5/2001 |

* cited by examiner

*Primary Examiner*—Hoang Ngo
(74) *Attorney, Agent, or Firm*—Global IP Counselors, LLP

(57) ABSTRACT

A color printer is disclosed which includes a photosensitive drum, a rotary developing device, a laser unit, a toner container, and a toner supply device. The rotary developing device is located adjacent to the photosensitive drum and includes a plurality of developing units corresponding to a plurality of colors. The laser unit is located above the photosensitive drum and on the rear side in the device. The toner container is located above the photosensitive drum and on the front side in the device. The toner container contains each color toner to be supplied to each of the developing units. The toner supply device is located above the photosensitive drum and between the laser unit and the toner container. The toner supply device supplies each of the developing units with each of color toners contained in the toner container.

3 Claims, 7 Drawing Sheets

COLOR IMAGE FORMING DEVICE

BACKGROUND OF THE INVENTION

1. Field of the Invention

The present invention relates to a color image forming device, and more particularly to a color image forming device that includes a rotary developing device for rotating a plurality of developing units for development, and a toner container located apart from the developing device from which toner is supplied to the developing units.

2. Background Information

A color image forming device includes a plurality of developing units corresponding to a plurality of color toners. The developing units are arranged in several ways, such as in a lateral direction, around the photosensitive drum in a circumferential direction, and within a rotary frame located adjacent to the photosensitive drum.

The rotary developing device having a plurality of the developing units within the rotary frame is shown in Japanese Unexamined Patent Publication No. 62-182768. In this device, the rotary frame is rotatably located adjacent to the photosensitive drum, and supports four color developing units. When the rotary frame is rotated, each of the developing units is sequentially placed opposite the photosensitive drum so as to develop each color.

In addition, other types of the rotary developing device have been proposed so as to reduce the size of the rotary frame, for example, in Japanese Unexamined Patent Publications No. 10-198149 and No. 2001-134045. The rotary developing device includes a toner container located apart from the developing units supported by the rotary frame. In this device, the toner is supplied from the toner container to the developing units through a toner supply device including toner supply pipes.

In the device, the toner container is located separate and apart from the developing device so that the developing units are downsized and the rotary frame is also downsized. However, it is necessary to ensure a space for the toner container, otherwise the image forming device as a whole may grow in size even though the rotary frame itself is reduced in size. In this respect, the device shown in Japanese Unexamined Patent Publication No. 2001-134045 includes a toner container located at an axial end of the rotary developing device so as to provide a long axial length, although Japanese Unexamined Patent Publication No. 10-198149 does not show the specific location of the toner container.

In the image forming device, a fixing device is typically composed of a fixing roller having a heat source and a pressing roller. In the image forming process, it is necessary to keep the fixing roller at a high temperature to fix the toner image to the transfer sheet, thereby generating radiant heat. In addition, a driving motor for driving the photosensitive drum generates heat in the imager forming process. These heat sources increase temperature in the image forming device, and thus the quality of formed images and the lifespan of the mechanical components in the image forming device might be affected. In particular, some image forming devices are downsized and the layout in the device is restricted so that low heat resistance components and heat sources may be located close together.

In order to solve the problem, in the device shown in Japanese Unexamined Patent Publication No. 2000-98860, heat from the fixing device is exhausted so as to prevent the temperature in the image forming device from increasing and improve the quality of the formed image. In the device shown in Japanese Unexamined Patent Publication No. 2000-98860, an exhausting means is provided to guide the heat generated by the fixing means to a conveyance path located above the fixing means by means of natural convection. Although it is possible to exhaust the heat from the fixing means in this device, it is necessary to further prepare a cooling duct for exhausting the heat from other heat sources, and thus it is difficult to further reduce the image forming device in size.

It is an object of the present invention to reduce the size of the rotary developing device without letting the image forming device grow in size.

It is another object of the present invention to reduce the image forming device in size and cost by exhausting the heat from the heat sources through a minimum space for cooling.

SUMMARY OF THE INVENTION

A color image forming device according to a first aspect of the present invention comprises a rotary photosensitive drum, a rotary developing device, an exposure device, a toner container, a toner supply device, an intermediate transfer member, a secondary transfer member, and a fixing device. The rotary photosensitive drum has a surface on which an electrostatic latent image is formed. The rotary developing device is located adjacent to the photosensitive drum and includes a plurality of developing units corresponding to a plurality of colors. The rotary developing device opposes each of the developing units to the photosensitive drum for development. The exposure device is located above the photosensitive drum and on a first side in a direction that intersects with a rotational axis of the photosensitive drum. The exposure device scans the surface of the photosensitive drum for exposure by a laser light in accordance with image data. The toner container is located above the photosensitive drum and on a second side opposite to the first side. The toner container contains each color toner to be supplied to each of the developing units. The toner supply device is located above the photosensitive drum and between the exposure device and the toner container. The toner supply device supplies each of the developing units with each of color toners contained in the toner container. The intermediate transfer member is located below the toner container and opposing to the photosensitive drum. Toner images in each color formed on the photosensitive drum are sequentially transferred to the intermediate transfer member. The secondary transfer member transfers the toner image transferred on the intermediate transfer member onto a sheet (transfer medium). The fixing device fixes the toner image transferred on the sheet.

In this device, the image bearing member is scanned for exposure by the laser light in accordance with the image data so that an electrostatic latent image is formed on the surface of the image bearing member. Then, each of the developing units of the developing device is opposed to the photosensitive drum so as to develop the electrostatic latent image on the photosensitive drum. The developed image is transferred onto the intermediate transfer member. The same operation is carried out for each color so that the image is sequentially transferred and superimposed onto the intermediate transfer member. Then, the full color image on the intermediate transfer image is collectively transferred to the sheet through the secondary transfer member. After that, the image on the sheet is fixed by the fixing device.

In this device, because the photosensitive drum, the developing device, the exposure device and the toner container are located as noted above, an empty space is ensured on the side opposite to the exposure device above the photosensitive drum. Accordingly, in the present invention, the toner container is located in the empty space, i.e., on the side opposite to the exposure device and above the photosensitive drum.

As mentioned above, it is possible to reduce a driving member of the rotary developing device in size and cost as well as the rotary developing device in size without increasing the size of the image forming device, because the toner container apart from the developing device is located in a dead space ensured by the arrangement of each of the components in the device. As a result, distances between the developing units will be shortened because of the downsizing of the rotary developing device, and thus the time for switching the development with each color will be shortened, and thereby speed up color printing.

According to a second aspect of the present invention, the color image forming device of the first aspect further comprises a discharge unit located above the exposure device to which the sheet is discharged after image formation is completed.

In this device, the sheet on which the image is fixed is conveyed upward and is discharged to the discharge unit located above the exposure device. The area occupied due to the installation of the device can be reduced compared to the case in which the discharge unit is provided outside of the body of the device, because the discharge unit is located above the exposure device.

According to a third aspect of the present invention, the color image forming device of the second aspect further comprises a sheet feeding cassette for storing sheets. The sheet feeding cassette is located below the intermediate transfer member such that the sheet feeding cassette can be extracted toward the toner container side.

According to a fourth aspect of the present invention, the color image forming device of the third aspect further comprises a sheet conveyance path located between the sheet feeding cassette and the intermediate transfer member. The path conveys the sheet in the sheet feeding cassette to the secondary transfer member, and further to the fixing device from the secondary transfer member.

According to a fifth aspect of the present invention, the color image forming device of the fourth aspect further comprises a return conveyance path located vertically between the sheet conveyance path and the sheet feeding cassette. The return conveyance path returns the sheet that has passed though the fixing device upstream of the secondary transfer member in the sheet conveyance path in a sheet conveyance direction.

In this device, in a case where the image is formed on both surfaces of the sheet, the sheet is conveyed through the sheet conveyance path to form the image on a front surface of the sheet, and after passing through the fixing device, the sheet is returned by the return conveyance path upstream of the secondary transfer member in the sheet conveyance direction, and is again conveyed through the sheet conveyance path to form an image on a rear surface of the sheet.

In addition, the return conveyance path is located below the sheet conveyance path and above the sheet feeding cassette so that the return conveyance path makes it possible to prevent the occupying area for the installation of the device from increasing.

According to a sixth aspect of the present invention, the color image forming device of the third aspect further comprises a sheet tray onto which the sheet can be placed. The sheet tray is located below the toner container and above the sheet feeding cassette and on the outside of the toner container in the device.

According to a seventh aspect of the present invention, in the color image forming device of the third aspect, the toner container can be attached to and detached from the body of the device in the same direction as the direction in which the sheet feeding cassette can be pulled out.

According to an eighth aspect of the present invention, the color image forming device comprises an image forming unit, a fixing device, an exposure device, a cooling duct, and a fan. The image forming unit forms a toner image on a sheet in accordance with image data. The fixing device fixes the toner image on the sheet. The fixing device is located downstream of the image forming unit in a sheet conveyance direction. The fixing device includes a heating member. The exposure device is located above the fixing device such that the exposure device and the fixing device are opposed to and apart from each other. The exposure device irradiates the image forming unit with a laser light. The cooling duct is located between the fixing device and the exposure device, extending in a longitudinal direction of the heating member. In this specification, "cooling duct" includes spaces as ducts surrounded by components of the image forming device. The fan discharges air from the cooling duct or pumps air into the cooling duct from the exterior of the image forming device.

In the image forming process, sources of luminescence such as the exposure device generate heat, and the heat roller of the developing device generates radiant heat. In this device, the cooling duct is located between the fixing device and the exposure device, and the fan discharges air from the cooling duct or pumps air into the cooling duct from the exterior of the image forming device. Accordingly, one cooling duct can exhaust the heat generated at the fixing device and the exposure device, so that the device is downsized compared to the conventional devices that require a plurality of cooling ducts. Furthermore, it is unnecessary to provide a plurality of fans, unlike the device having a plurality of cooling ducts, so that it is possible to reduce fan noise as well as reduce the cost.

According to a ninth aspect of the present invention, in the color image forming device of the eighth aspect, the fan is located at a longitudinal end of the cooling duct.

In the device, the cooling duct is formed along the longitudinal direction of the heat member and the fan is located at the longitudinal end of the cooling duct, so that the heat generated at the heat member of the developing device is efficiently exhausted.

According to a tenth aspect of the present invention, in the color image forming device of the eighth aspect, the image forming unit further includes an image bearing member which is scanned by a laser light from the exposure device for exposure, a plurality of developing units for developing the electrostatic latent image on the image bearing member with the color toners, and a rotary frame supporting the developing units that places each of the developing units opposite the image bearing member. The cooling duct is opposite the rotary frame.

In the device, the rotary developing device including the rotary frame is employed as a developing device and the cooling duct is located opposing to the rotary frame, which is mounted above the fixing device. The heat is prevented from diffusing to the developing device by exhausting the heat from the fixing device, and thus the image formed by the device is less likely to be affected by an increase in temperature in the image forming device.

According to an eleventh aspect of the present invention, the color image forming device of the ninth aspect further comprises a motor mounted at the end of the cooling duct opposite to the fan for driving the rotary frame.

In the device, the driving motor for driving the rotary frame of the image forming device is provided at the end of the cooling duct opposite to the fan so that the driving motor should be one of heat sources. In the present invention, however, the cooling duct can exhaust the heat from the driving motor. Accordingly, it is unnecessary to provide another cooling duct, and thus the device is reduced in size and cost.

According to one aspect of the present invention, it is possible to reduce the driving member of the rotary developing device in size and cost, as well as the rotary developing device in size, without increasing a size of the image forming device, because the toner container apart from the developing device is located in a dead space ensured by the arrangement of each of the components in the device. As a result, the distances between the developing units will be shortened due to downsizing of the rotary developing device, so that the time for switching the development with each color is shortened, thereby speeding up color printing.

According to another aspect of the present invention in the image forming device, the cooling duct is located between the fixing device and the exposure device, and the fan discharges air from the cooling duct or pumps air into the cooling duct from outside. Accordingly, one cooling duct can exhaust the heat generated at the fixing device and the exposure device, so that the device is downsized compared to the conventional devices that require a plurality of cooling ducts. Furthermore, it is unnecessary to provide a plurality of fans unlike the device having a plurality of cooling ducts, and thus it is possible to reduce fan noise as well as reduce the cost.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Figure 1:
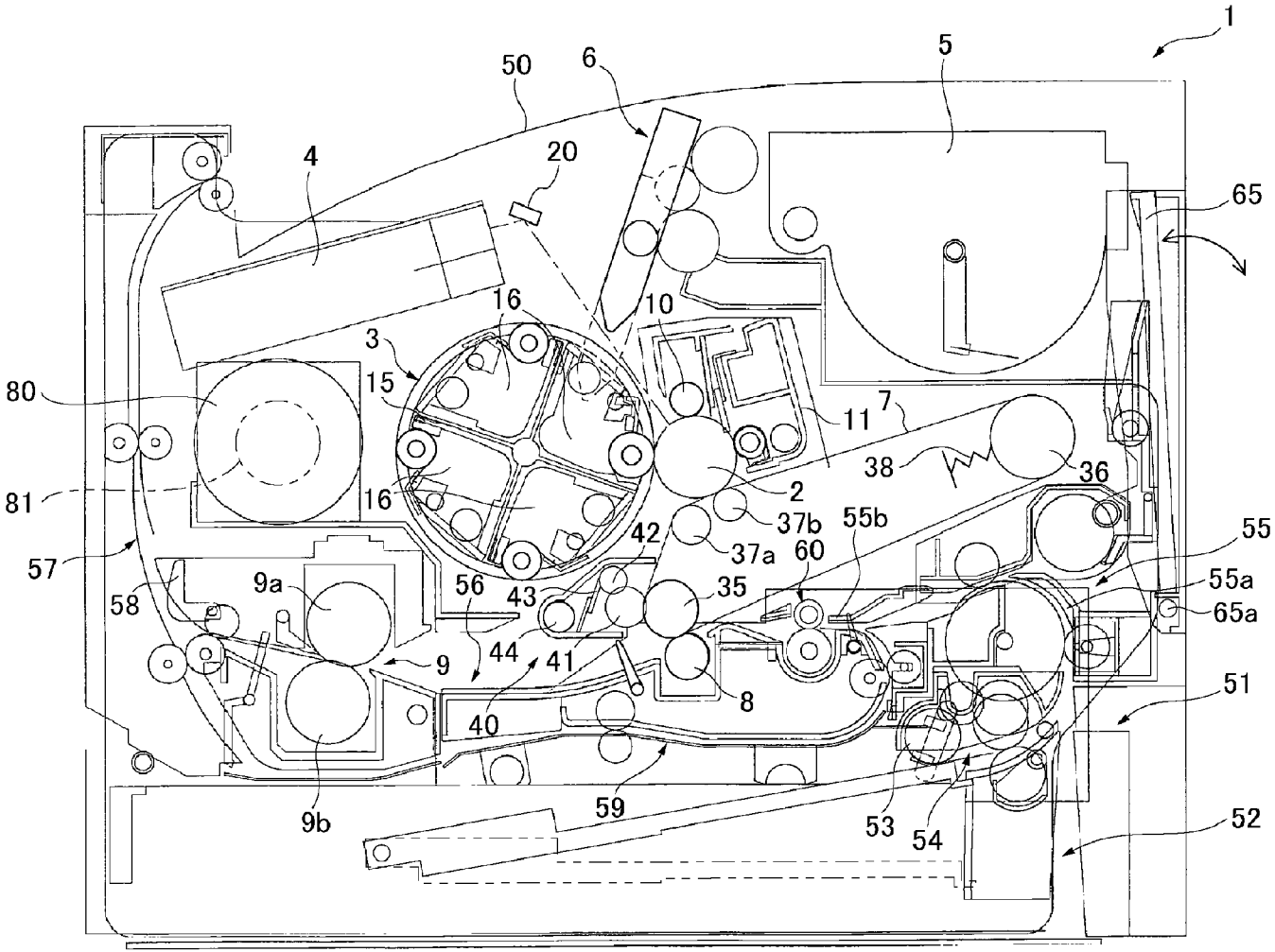
FIG. 1 is a schematic structural view of a color printer according to an embodiment of the present invention.

FIG. 1 shows a color printer 1 as a color image forming device according to one embodiment of the present invention. FIG. 1 is a view showing a frame format of the locations of each of the components, and thus details of each of portions are omitted.

Overall Structure

The color printer 1 is connected to a computer, for example, and is capable of printing a color image on a sheet (transfer medium) in accordance with image data sent from the computer. In this color printer 1, the right side of FIG. 1 is the side from which an operator operates the color printer 1. In the below description, the right side in FIG. 1 is referred to as the "front side" and the left side in FIG. 1 is referred to as the "rear side".

The color printer 1 includes a photosensitive drum 2, a rotary developing device 3, a laser unit 4 as an exposure device, a toner container 5, a toner supply device 6, an intermediate transfer belt 7, a secondary transfer roller 8, a fixing device 9, and a cooling duct 80.

Photosensitive Drum

The photosensitive drum 2 has a surface on which an electrostatic latent image is formed, and is rotatably mounted substantially in the center of the device. The rotational axis of the photosensitive drum 2 is located such that the axis extends in a lateral direction seen from the front side of the device, i.e., perpendicular to a paper surface of FIG. 1. On an upper portion of the photosensitive drum 2, a charge roller 10 for uniformly charging a surface of the photosensitive drum 2 is mounted. On a lateral side of the photosensitive drum 2, a drum cleaning device 11 is mounted for cleaning residual toner and other matter on the surface of the photosensitive drum 2.

Rotary Developing Device

The rotary developing device 3 is a device for developing an electrostatic latent image formed on the photosensitive drum 2 with each color toner. The rotary developing device 3 is located adjacent to the photosensitive drum 2 and has a center substantially corresponding to the center of the photosensitive drum 2 in a vertical direction. The rotary developing device 3 includes a rotary frame 15 and four developing units 16 corresponding to four color toners and supported by the rotary frame 15. The rotary frame 15 is a cylindrical member rotatable around an axis in parallel with the rotational axis of the photosensitive drum 2 and is driven by a drive mechanism including a motor and gears (not illustrated). In addition, the rotary frame 15 is formed with four compartments divided into quarters by partitions extending from the center of the rotational axis radially outward. Each of the compartments accommodates each of the developing units 16 (16*a* to 16*d*) corresponding to four color toners such as yellow, cyan, magenta, and black.

Figure 2:
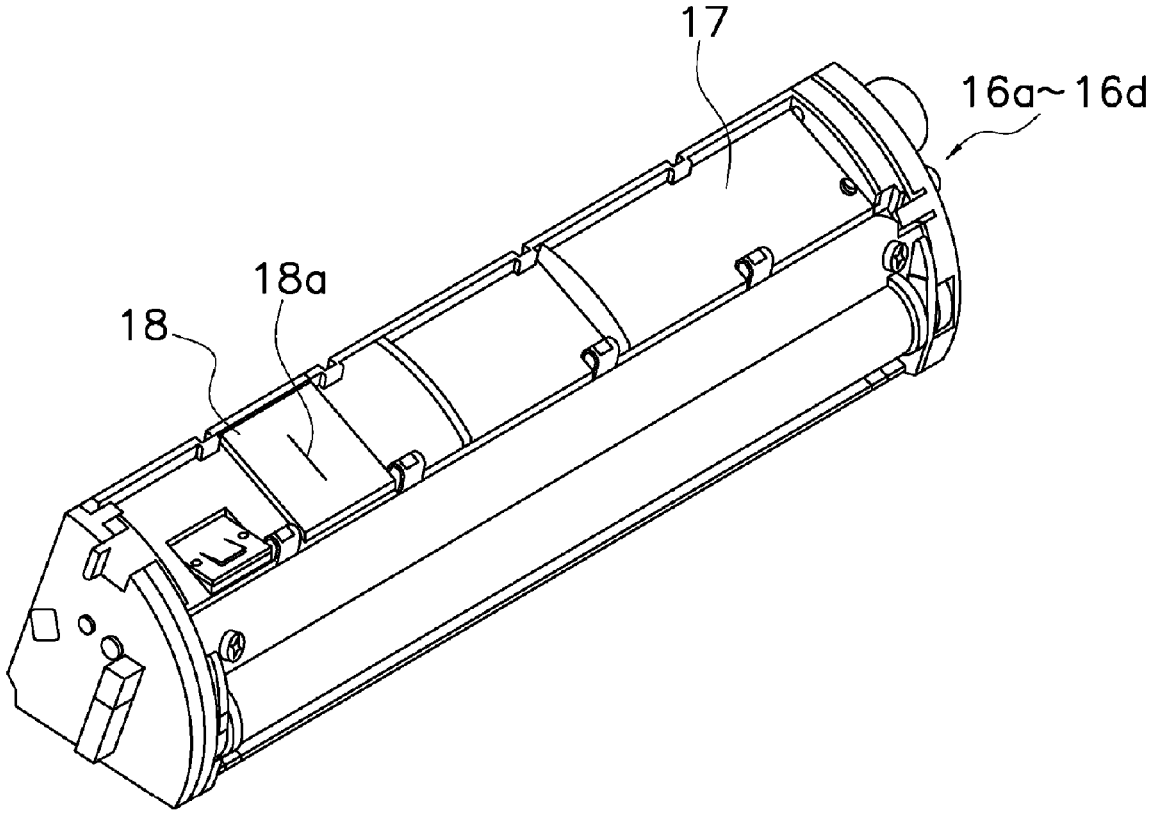
FIG. 2 is an external perspective view of the developing unit.

Each of the developing units 16*a* to 16*d* has a common structure and includes a developing roller capable of being located so as to be opposed to the photosensitive drum 2, and an agitation roller for agitating the toner. One of the four developing units 16 is shown in FIG. 2. In the present invention, a toner container (later described) is separately located apart from the developing units 16, so that the toner containment space of the developing units themselves in the present embodiment is smaller. In other words, the developing units 16 are downsized compared to a developing device including an internal toner container. On an outer surface of a case 17 of the developing unit 16, a toner supply portion 18 is provided as shown in FIG. 2, so as to supply the toner from the toner container 5 into the developing unit 16. The toner supply portion 18 having an elastic member with a slit 18*a* is located at an opening of the case 17.

Laser Unit

The laser unit 4 is a device to scan and expose the photosensitive drum 2 in accordance with image data sent from the external computer, and is located above the photosensitive drum 2 and on the rear side (first side) of the rotational axis of the rotary developing device 3. More specifically, the front end of the laser unit 4, i.e., the end from which laser light is emitted, is located immediately above the rotational axis of the rotary developing device 3, and the rear end is located below the upper end of the rotary developing device 3, with the whole of the laser unit 4 slanting downward toward the rear end. The inner construction of the laser unit 4 is common with that of conventional laser units, and includes a laser light source, a polygon mirror, a motor for driving the polygon mirror, and so on. In addition, on the front side of a laser light path from the laser unit 4, a reflective mirror 20 is provided so that the laser light emitted from the laser unit 4 is reflected by the reflective mirror 20, and is applied to the surface of the photosensitive drum 2.

Toner Container

Figure 5:
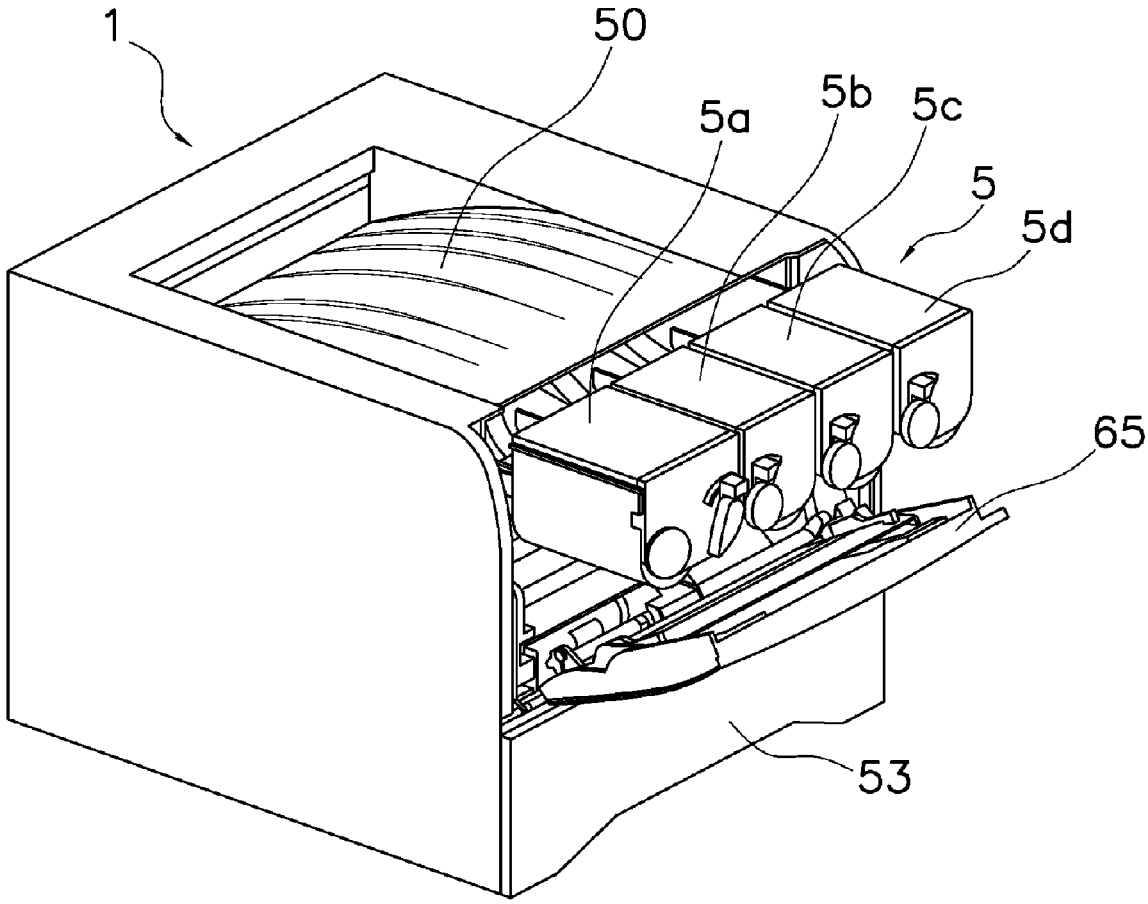
FIG. 5 is a perspective view of the color printer showing the toner containers extracted halfway.

The toner container 5 is a member for storing toner to be supplied to each of the developing units 16 of the rotary developing device 3, and is located above the photosensitive drum 2 and on a side opposite to the laser unit 4 (on the front side, i.e., the second side in the device). The toner container 5 includes, as shown in FIG. 5, four containers 5*a*, 5*b*, 5*c*, and 5*d* arranged in a lateral direction, i.e., in a direction perpendicular to the sheet in FIG. 1, for storing color toner such as yellow, cyan, magenta, and black. The toner container 5 can be pulled out toward the front side of the device.

Toner Supply Device

Figure 3:
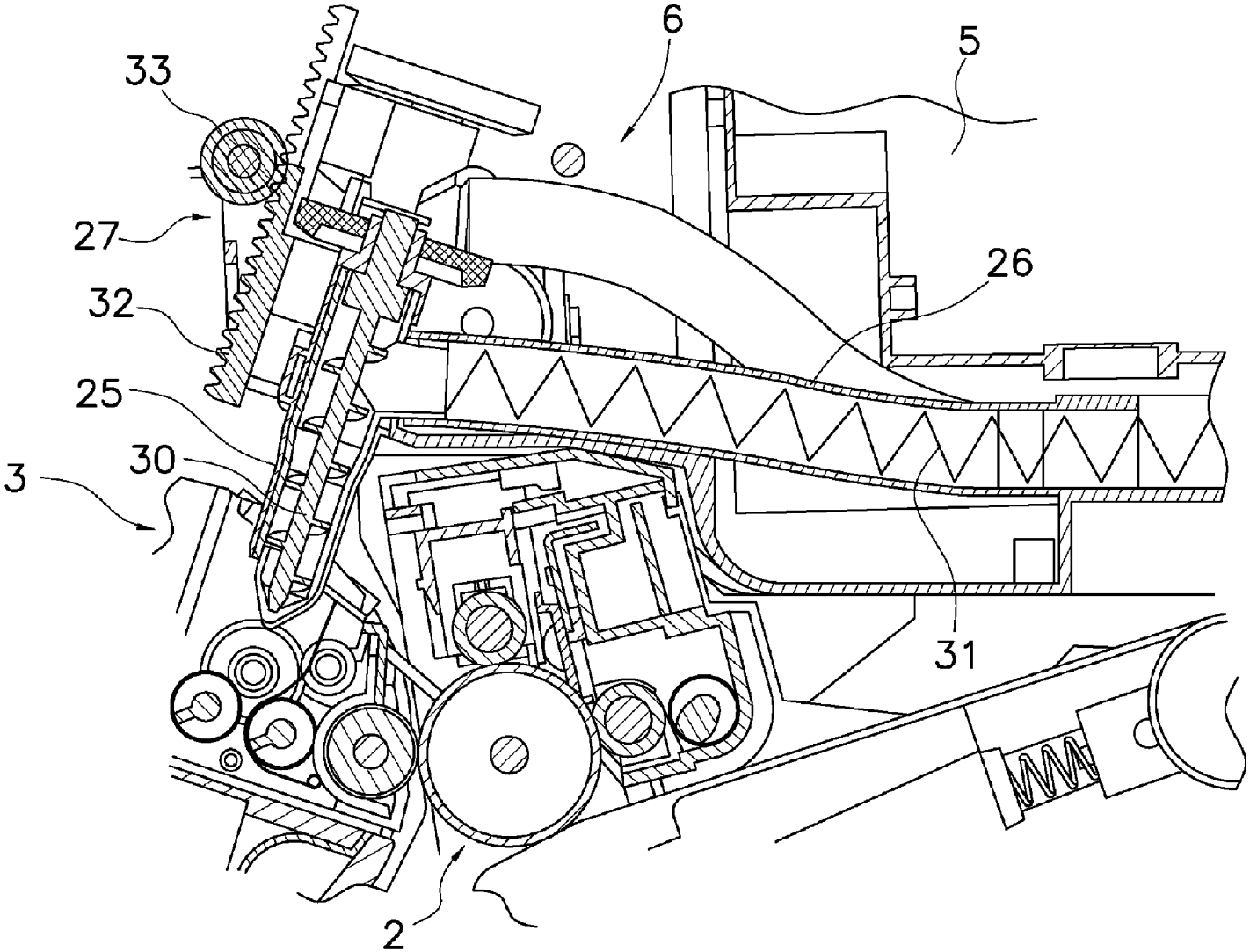
FIG. 3 is a detailed sectional view of the toner supply device.

The toner supply device 6 is a device to supply each of the toners contained in the toner container 5 to the corresponding developing units 16, and is located above the photosensitive drum 2 and in a space between the laser unit 4 and the toner container 5. The toner supply device 6 includes, as shown in FIG. 3, four toner supply pipes 25 that are vertically movable, four conveyance pipes 26 for connecting portions storing each color toner in the toner container 5 with corresponding toner supply pipes 25, and a drive mechanism 27 for moving the toner supply pipes 25 up and down.

The toner supply pipe 25 extends vertically and is inclined such that an upper end is on the front side in the device and a lower end is on the rear side in the device. The toner supply pipe 25 has a tapered tip, which can advance into the inside of the developing unit 16 through the slit 18*a* of the toner supply portion 18 when the toner supply pipe 25 moves downward. Inside of the toner supply pipe 25, a spiral member 30 for conveying the toner is rotatably installed.

The conveyance pipe 26 is so flexible that the pipe 26 can follow vertical movements of the toner supply pipe 25. Inside of the conveyance pipe 26, a coil spring 31 is provided for conveying the toner to the toner supply pipe 25 within the conveyance pipe 26 when the coil spring 31 is rotated by a drive mechanism (not illustrated).

The drive mechanism 27 includes racks 32 provided on the outer circumference of the toner supply pipes 25 and extending in the axial direction of the pipes 25, and pinion gears 33 engaged with the racks 32. The pinion gears 33 are rotatably supported by a frame of the device and are driven by motors (not illustrated) and so on. The drive mechanism 27 makes it possible for the four toner supply pipes 25 to move between a retracted position upward and a supply position downward, wherein the tip is inserted into the developing unit 16.

The toner supply pipe 25 has a shutter mechanism which opens only when the toner supply pipe 25 is positioned in the supply position. More specifically, the toner supply pipe 25 has an overlapped structure of an inner cylinder and an outer cylinder, and tips of the cylinders are formed with an opening having a circumferential length. In addition, the outer cylinder is formed with a protruding portion engaged with a rotary cam having a spiral groove located around the outer cylinder. When the toner supply pipe 25 is in the retracted position upward, the openings of the inner cylinder and the outer cylinder do not overlap with each other (shutter closed) so that the toner does not leak outside. On the contrary, when the toner supply pipe 25 moves downward, the outer cylinder rotates by means of the protruding portion and the rotary cam, the tip of the toner supply pipe 25 is inserted into the developing unit 16. Then, when the toner supply pipe 25 reaches the supply position, the openings of the inner cylinder and the outer cylinder overlap with each other (shutter opened) so that the inside toner is supplied to the inside of the developing unit 16 from the openings.

Intermediate Transfer Belt

The intermediate transfer belt 7 is a member on which the toner images in each color formed on the photosensitive drum 2 are sequentially transferred, and is located below the photosensitive drum 2 and the toner container 5. The intermediate transfer belt 7 is looped over a driving roller 35 and a follower roller 36 located in the opposite direction. A portion of the transfer belt 7 facing the photosensitive drum 2 is constructed so as to be brought into contact with the photosensitive drum 2 by a pair of primary transfer rollers 37*a* and 37*b*.

The arrangement of the above-mentioned components will be described in more detail. The driving roller 35 is located immediately below contact portions of the photosensitive drum 2 and the rotary developing device 3, and the center is positioned below the lowest end of the rotary developing device 3. The driving roller 35 is driven by a driving unit including a motor and gears (not illustrated). The follower roller 36 is located adjacent to a bottom of the toner container 5 and on the front side in the device, and its position in a vertical direction is substantially the same with a position of the photosensitive drum 2. The follower roller 36 is urged by a spring 38 in the direction opposite to the driving roller 35 so that the intermediate transfer belt 7 is tensioned. In addition, the primary transfer rollers 37*a* and 37*b* are located adjacent to each other below the photosensitive drum 2 so that a certain range of the transfer belt 7 is in contact with the photosensitive drum 2.

A belt cleaning device 40 for cleaning the transfer belt 7 is located on the rear side of the driving roller 35 and below the rotary developing device 3. The belt cleaning device 40 includes a fur brush 41 located in a position facing the driving roller 35 and in sliding contact with the surface of the transfer belt 7, a cleaning roller 42 located above the fur brush 41 so as to be in contact with the fur brush 41, a blade 43 having a tip located so as to be in contact with a surface of the cleaning roller 42, and a recovery spiral 44 located below the blade 43 side by side.

In this cleaning device 40, matter attached to the intermediate transfer belt 7 will be scraped off by the fur brush 41, and then recovered to the cleaning roller 42. This matter is then scraped off by the blade 43 from the surface of the cleaning roller 42 and then recovered to a recovery unit (not illustrated) by the recovery spiral 44.

Secondary Transfer Roller

The secondary transfer roller 8 is a member to transfer the image transferred on the intermediate transfer belt 7 onto the conveyed sheet and is located below the driving roller 35 and facing the driving roller 35. Bias voltage is applied to the secondary transfer roller 8 by an energizing means (not illustrated) so as to transfer the image to the sheet.

Fixing Device

The fixing device 9 is a device to fix the toner image transferred onto the sheet by fusion and is located below the rotary developing device 3 and on the rear side in the device. The fixing device 9 includes a heating roller 9*a* having a built-in heater and a pressure roller 9*b* pressing against the heating roller 9*a* for pinching the sheet therebetween so as to convey the sheet.

Cooling Duct

Figure 7:
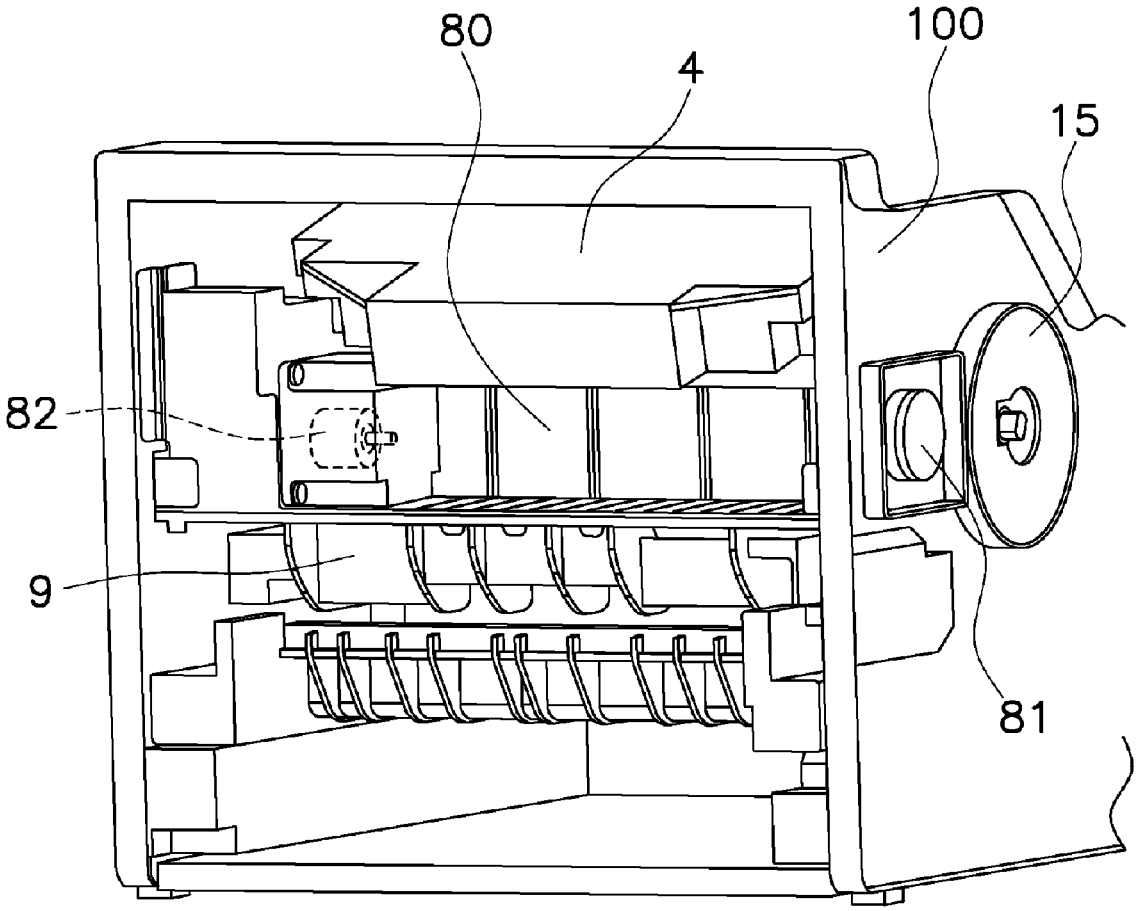
FIG. 7 is an exploded perspective view of the cooling duct.

A cooling duct 80 is, as shown in FIGS. 1 and 7, located on a left side of the rotary frame 15 (on the rear side in the device). The cooling duct 80 is located vertically between the fixing device 9 and the laser unit 4 and extends along the axial direction of the heating roller 9*a*.

Furthermore, at an end of the cooling duct 80, a fan 81 is provided for discharging air from the cooling duct 80. At the other end of the cooling duct 80 opposite to the fan 81, a motor 82 is provided for driving the rotary frame 15.

Discharge Unit

In the printer 1, on a surface of an upper portion of the device, i.e., above the laser unit 4, the toner supply device 6 and the toner container 5, the discharge unit 50 is provided onto which the image-formed sheet is discharged. The discharge unit 50 consists of a curved portion gradually increasing the height from the lowest portion on the laser unit 4 side (on the rear side in the device) to the other side on the toner container 5 side (on the front side in the device), and a flat portion continuous with the curved portion located above the toner container 5.

Sheet Feeding Unit

At the bottom of the device, the sheet feeding unit 51 for storing and dispatching the sheets is provided. The sheet feeding unit 51 includes a sheet feeding cassette 52 having a stack plate on which the sheets are stacked, a forward feeding roller 53 and a multiple feeding prevention mechanism 54 for sending individual sheets into the conveyance path. The sheet feeding cassette 52 can be pulled out toward the front side of the device.

Conveyance Mechanism

The conveyance mechanism for conveying sheets is located between the sheet feeding unit 51 and the discharge unit 50. The conveyance mechanism includes a first conveyance path 55 from the sheet feeding unit 51 to the secondary transfer roller 8, a second conveyance path 56 from the secondary transfer roller 8 to the fixing device 9, and a third conveyance path 57 from the fixing device 9 to the discharge unit 50. At an exit of the fixing device 9, a branching claw 58 is provided, and a return conveyance path 59 is provided between the branching claw 58 and a middle of the first conveyance path 55 for returning the sheet to the first conveyance path 55.

The first conveyance path 55 includes a curved path 55*a* for reversing the conveyance direction as well as conveying the sheet sent out from the sheet feeding cassette 52 upward, and a straight path 55*b* extending from the curved path 55*a* to the secondary transfer roller 8. These conveyance paths are composed of guide plates and pairs of rollers for guiding the sheet as well as conveying them, and include sensors installed at places for sensing the sheet. In addition, a pair of registration rollers 60 is provided in the straight path 55*b* for controlling conveyance timing of the sheets.

The second conveyance path 56 extends in a rectilinear direction, is composed of guide plates and pairs of rollers for guiding the sheets as well as conveying them, and includes sensors installed at places for sensing the sheet.

The third conveyance path 57 includes a vertical conveyance path formed downstream of the branching claw 58 in the conveyance direction. Namely, the sheet on which the image is fixed by heat and pressure by the fixing device 9 is conveyed upward in the vertical direction after passing the branching claw 58 and is discharged to the discharge unit 50. The third conveyance path 57 is also composed of guide plates and pairs of rollers for guiding the sheets as well as conveying them.

The return conveyance path 59 is a conveyance path which branches off downward from the third conveyance path 57 at a place where the branching claw 58 is mounted and extends below the fixing device 9, the second conveyance path 56, the secondary transfer roller 8 and the pair of the registration rollers 60, and then extends upward so as to join upstream of the pair of the registration rollers 60 in the first conveyance path 55 in the conveyance direction. Namely, the return conveyance path 59 is a conveyance path located between the sheet feeding cassette 52 and straight path 55*b* of the first conveyance path 55 as well as the second conveyance path 56. The path 59 returns the sheet passed through the fixing device 9 upstream of the pair of the registration rollers 60, which is located upstream of the secondary transfer roller 8. The return conveyance path 59 is also composed of guide plates and pairs of rollers for guiding the sheets as well as conveying them and includes sensors installed at places for sensing the sheet.

Sheet Feeding Tray

Below the toner container 5 and above the sheet feeding cassette 52, the sheet feeding tray 65 is provided so as to form a lateral wall on the front side of the device. The sheet feeding tray 65 has a lower end pivotably supported in the vicinity of the curved path 55*a* of the first conveyance path 55 such that the sheet feeding tray 65 can take an open position and a closed position. The upper end of the sheet feeding tray 65 can be reclined toward the front side of the device around a rotation center 65*a* in the lower end. Accordingly, when the sheet feeding tray 65 is opened, it is possible to put the sheet on the sheet feeding tray 65 and supply the curved path 55*a* of the first conveyance path 55 with the sheets.

Image Forming Operation

Next, the image forming operation will be explained in a simplified manner. First, when the power is applied to the color printer, a variety of parameters are initialized and initialization is executed such as setting a temperature of the fixing device. Then, when the image data from the computer connected to this printer is inputted and an instruction to start printing is given, the image forming operation is carried out as following. It should be noted that during the image forming operation the toner supply pipe 25 is moved to the retracted position upward.

First, the charge roller 10 charges the photosensitive drum 2. After that, the photosensitive drum 2 is scanned and exposed by the laser unit 4 in accordance with the image data so that the electrostatic latent image is formed on the photosensitive drum 2. Next, the rotary developing device 3 is rotated and the developing unit 16 whose color is designated is opposed to the photosensitive drum 2. In this state, the electrostatic latent image on the photosensitive drum 2 is developed with the designated toner color. The developed image is transferred to the intermediate transfer belt 7. The above-mentioned operation is sequentially carried out color by color so that the full color image is formed on the intermediate transfer belt 7. It should be noted that residual toner on the photosensitive drum 2 is cleaned by the drum cleaning device 11 and is discarded into a discarded toner container (not illustrated).

In the sheet feeding unit 51, a sheet is taken out from the sheet feeding cassette 52 by the forward feeding roller 53 and multiple feeding prevention mechanism 54, and is conveyed to the pair of the registration rollers 60 through the first conveyance path 55. Then, the sheet is conveyed from the pair of the registration rollers 60 to the intermediate transfer belt 7 with timing of image forming thereon and guided to the secondary transfer roller 8. The secondary transfer roller 8 is in contact with the intermediate transfer belt 7 and the full color image formed on the intermediate transfer belt 7 is transferred to the sheet by transfer bias applied to the secondary transfer roller 8. The sheet is guided to the fixing device 9 through the second conveyance path 56, and the image is fixed to the sheet by heat and pressure in the fixing device 9. In the case of one-side printing, the sheet is guided to the third conveyance path 57 by means of the branching claw 58, and then is discharged to the discharge unit 50.

In the case of double-side printing, after fixation in the fixing device 9, the sheet is guided by the branching claw 58 toward a side of the return conveyance path 59 and is returned to the first conveyance path 55 again. The sheet is temporarily stopped by the pair of the registration rollers 60. The sheet is sent with precise timing toward the secondary transfer roller 8 after the rear side image is formed on the intermediate transfer belt 7 in the same operation mentioned before. After that, the same operation is carried out and the sheet is guided toward the third conveyance path 57 by means of the branching claw 58 and is discharged to the discharge unit 50.

Toner Supply Operation

When the toner is supplied to the developing units 16, the rotary developing device 3 is rotated such that the developing unit 16 to which the toner will be supplied is positioned in the supply position as shown in FIG. 1. The rotary developing device 3 is locked so as not to rotate in this state. Next, the toner supply pipe 25 is moved downward to the supply position. More specifically, the motor (not illustrated) drives the pinion gear 33 with the gears so that the toner supply pipe 25 to which the rack 32 is fixed is moved downward. Meanwhile, the toner is supplied to the toner supply pipe 25 from the toner container 5 through the conveyance pipe 26. The tip of the toner supply pipe 25 advances through the slit 18*a* as a toner supply opening into the developing unit 16. During the downward movement of the toner supply pipe 25, the outer cylinder rotates relative to the inner cylinder. Upon the entry of the tip of the toner supply pipe 25 into the developing unit 16, the openings of the outer cylinder and the inner cylinder correspond to each other. In other words, the shutter mechanism is opened so that the toner inside of the toner supply pipe 25 is supplied into the developing unit 16.

It should be noted that although the toner supply pipe 25 blocks the laser light path from the laser unit 4 to the photosensitive drum 2 when toner supply pipe 25 is positioned in the supply position, it is not a cause for concern because the toner supplying operation by the toner supply pipe 25 and the image forming operation are not carried out simultaneously.

As is clear from FIG. 1, if the photosensitive drum 2, the rotary developing device 3, the laser unit 4, the intermediate transfer belt 7 and the conveyance mechanism are disposed as in the present embodiment, an empty space is ensured above the photosensitive drum 2 and on the front side in the device, i.e., on the front side of the laser unit 4. In the present embodiment, in the empty space, i.e., the dead space, the toner container 5 separately located apart from the developing units 16 is provided so that it is possible to make effective use of the space in the device. Accordingly, in the device wherein the toner container is provided apart from the developing units for reducing the rotary developing device in size in the printer employing the rotary developing system, growing of the whole size of the printer is avoided. In addition, the distances between the developing units will be shortened because of the downsizing of the rotary developing device 3, and thus the time for switching the development with each color will be shortened and thereby speed up color printing.

It is possible to reduce the area occupied due to the installation of the printer, because the discharge unit 50 is located on the upper portion of the printer, the sheet feeding cassette 52 is located at the bottom of the device, and the return conveyance path 59 is located between the sheet conveyance path and the sheet feeding cassette 52.

Figure 4:
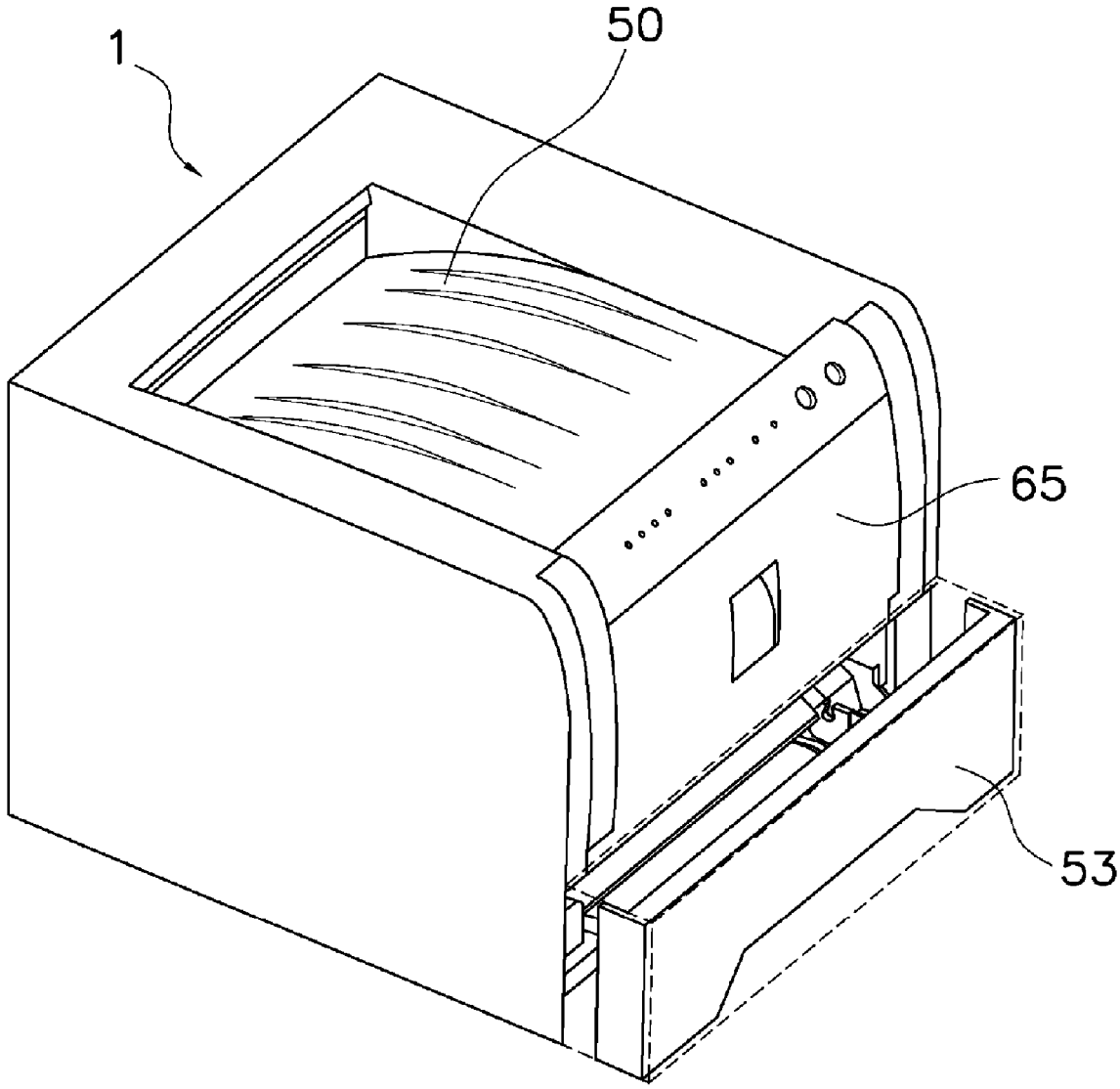
FIG. 4 is a perspective view of the color printer showing the sheet feeding cassette extracted halfway.
Figure 6:
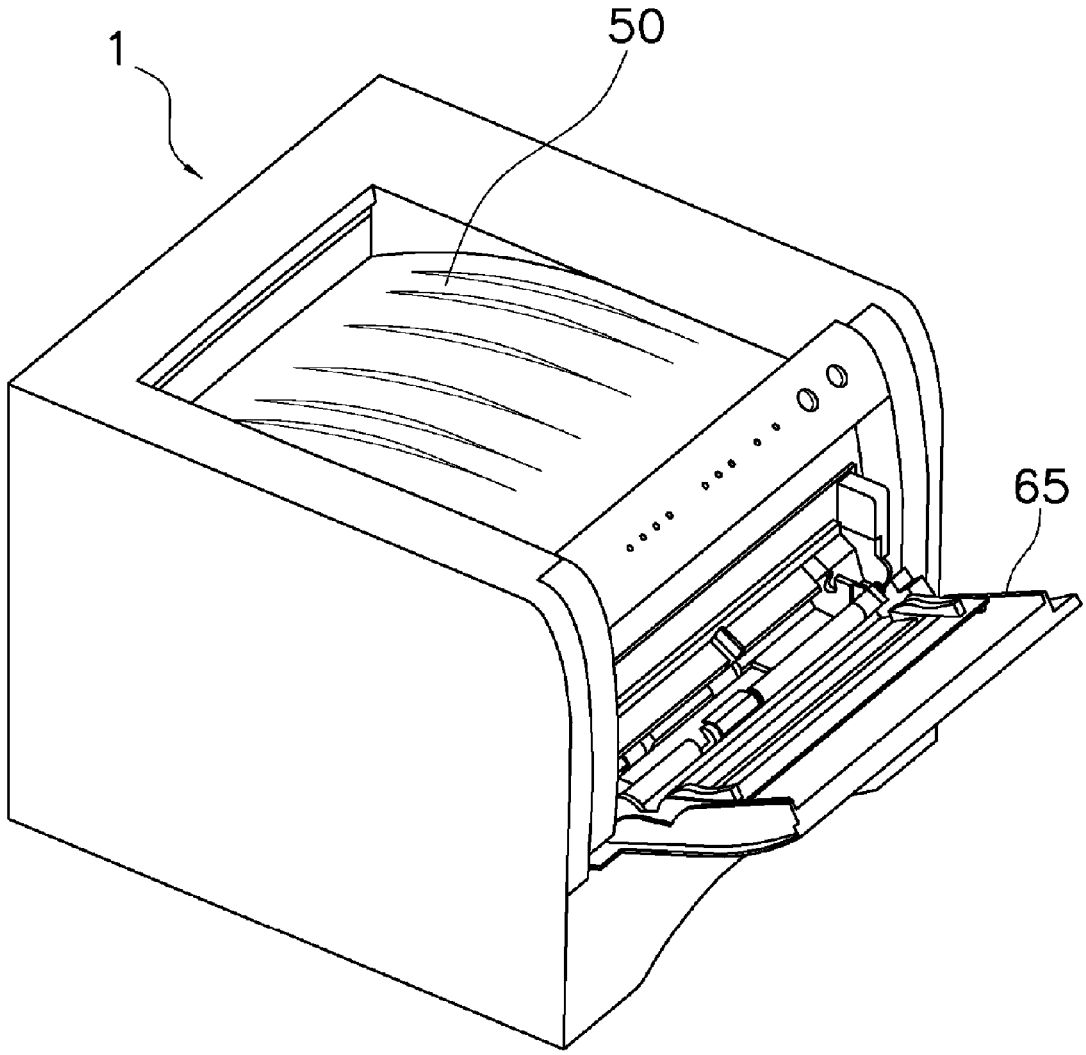
FIG. 6 is perspective view of the color printer showing the sheet feeding tray opened.

FIGS. 4 to 6 show the sheet feeding cassette 52 extracted halfway, the toner container 5 removed halfway, and the sheet feeding tray 65 opened, respectively. As clear from the figures, the sides from which the sheet feeding cassette 52, the toner container 5 and the sheet feeding tray 65 are operated are the same, i.e., on the front side of the device, and thus workability is improved.

It is possible to reduce the overall size of the printer, because the toner supply device 6 is located by making effective use of a space between the laser unit 4 and the toner container 5. More specifically, the space between the laser unit 4 and the toner container 5 corresponds, in this embodiment, to the laser light path, so that the components such as toner supply pipes can not be located therein usually. In this embodiment, however, focusing attention on the fact that the toner supply operation and the image forming operation are not carried out simultaneously, the toner supply pipe 25 is moved to the retracted position so as not to hinder the image forming operation during the image forming operation, and is moved to the supply position where the toner supply pipe 25 blocks the laser light path, i.e., it makes use of a portion of the laser light path. Accordingly, the space is effectively utilized and the printer is reduced in size.

The cooling duct 80 is located between the fixing device 9 and the laser unit 4 along the axial direction of the heating roller 9*a*, and the fan 81 is located at an end of the cooling duct 80 for spewing out air in the cooling duct 80. At the other end of the cooling duct 80 opposite to the fan 81, the motor 82 for driving the rotary frame 15 is provided. Accordingly, one cooling duct 80 can exhaust the heat generated at the fixing device 9, the laser unit 4 and the motor 82 so that the device is downsized compared to conventional devices that require a plurality of cooling ducts. Furthermore, the third conveyance path 57 is located opposite to the cooling duct 80, so that the cooling duct 80 can also cool the sheet on which the image is fixed by heat and pressure by means of the third conveyance path 57 and the fixing device 9. Accordingly, it is unnecessary to provide a plurality of fans unlike the device having a plurality of cooling ducts, so that it is possible to reduce fan noise as well as reducing the cost. In other words, the printer 1 is reduced in size and cost.

Other Embodiment

Although the fan 81 is a device for discharging air from the cooling duct 80 in the above-mentioned embodiment, a fan for sending outside air into the cooling duct 80 achieves a similar effect. In addition, the similar effect is achieved when a fan can either choose to discharge air from the cooling duct 80 or send outside air into the cooling duct 80 as needed by changing the rotational direction of the fan.

Any terms of degree used herein, such as "substantially", "about" and "approximately", mean a reasonable amount of deviation of the modified term such that the end result is not significantly changed. These terms should be construed as including a deviation of at least ±5% of the modified term if this deviation would not negate the meaning of the word it modifies.

This application claims priority to Japanese Patent Application Nos. 2004-316783 and 2004-370006. The entire disclosure of Japanese Patent Application Nos. 2004-316783 and 2004-370006 is hereby incorporated herein by reference.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing description of the embodiments according to the present invention are provided for illustration only, and not for the purpose of limiting the invention as defined by the appended claims and their equivalents.

What is claimed is:

1. An image forming device comprising:

an image forming unit that forms a toner image on a transfer medium in accordance with image data, the image forming unit including an image bearing member which is scanned for exposure by a laser light from an exposure device, a plurality of developing units that develop the image on the image bearing member with color toners, and a rotary frame supporting the developing units that places each of the developing units opposite the image bearing member;

a fixing device that fixes the toner image on the transfer medium, the fixing device located downstream of the image forming unit in a sheet conveyance direction, and includes a heating member;

a cooling duct opposite the rotary frame and located between the fixing device and the exposure device, the cooling duct extending in a longitudinal direction of the heating member; and a fan for discharging air from the cooling duct or pumping air into the cooling duct from the exterior of the image forming devices, the exposure device located above the fixing device such that the exposure device and the fixing device are opposed to and separated from each other, the exposure device irradiating the image forming unit with a laser light.

2. An image forming device according to claim 1, wherein the fan is located at a longitudinal end of the cooling duct.

3. An image forming device according to claim 2, further comprising a motor mounted at an end of the cooling duct opposite to the fan, the motor driving the rotary frame.

* * * * *